US009206018B2

(12) United States Patent
Attwood

(10) Patent No.: US 9,206,018 B2
(45) Date of Patent: Dec. 8, 2015

(54) HOIST ROPE EQUALISER

(75) Inventor: Reece Attwood, Mayfield West (AU)

(73) Assignee: Bradken Resources Pty Limited, Mayfield West (AU)

( * ) Notice: Subject to any disclaimer, the term of this patent is extended or adjusted under 35 U.S.C. 154(b) by 415 days.

(21) Appl. No.: 12/776,936

(22) Filed: May 10, 2010

(65) Prior Publication Data

US 2011/0272656 A1 Nov. 10, 2011

(51) Int. Cl.
*B66C 3/12* (2006.01)

(52) U.S. Cl.
CPC ..... *B66C 3/125* (2013.01)

(58) Field of Classification Search
USPC ..... 37/394–401; 254/399; 212/78, 79, 271
See application file for complete search history.

(56) References Cited

U.S. PATENT DOCUMENTS

| | | | | | |
|---|---|---|---|---|---|
| 1,369,842 | A * | 3/1921 | Schaffernocker | 24/136 K |
| 1,380,800 | A * | 6/1921 | Haworth | 403/211 |
| 1,850,896 | A * | 3/1932 | Roe | 403/72 |
| 3,531,088 | A * | 9/1970 | Kraschnewski | 254/292 |
| 3,681,808 | A * | 8/1972 | Hahn et al. | 24/115 R |
| 3,877,581 | A * | 4/1975 | Auxer | 212/195 |
| 4,718,788 | A * | 1/1988 | Briscoe | 403/211 |
| 4,944,102 | A * | 7/1990 | Behlendorf et al. | 37/398 |
| 5,243,739 | A * | 9/1993 | Schmidt | 24/135 R |
| 5,752,334 | A * | 5/1998 | Immel | 37/396 |
| 5,970,636 | A * | 10/1999 | Briscoe et al. | 37/396 |
| 5,992,061 | A * | 11/1999 | Fleck et al. | 37/397 |
| 6,209,234 | B1 * | 4/2001 | Meyers | 37/398 |
| 6,484,423 | B1 * | 11/2002 | Murray | 37/396 |
| 2011/0110708 | A1 * | 5/2011 | Miotke et al. | 403/64 |
| 2012/0291318 | A1 * | 11/2012 | Attwood | 37/399 |

FOREIGN PATENT DOCUMENTS

| | | | |
|---|---|---|---|
| AU | 2009202213 | A1 * | 12/2009 |
| AU | 2009250333 | | 3/2012 |
| WO | WO 2009140727 | A1 * | 11/2009 |

OTHER PUBLICATIONS

Patent Examination Report No. 1 dated Nov. 1, 2012, directed to Australian Application No. 2009202213; 8 pages.

* cited by examiner

*Primary Examiner* — Emmanuel M Marcelo
*Assistant Examiner* — Angela Caligiuri
(74) *Attorney, Agent, or Firm* — Morrison & Foerster LLP

(57) ABSTRACT

A load equaliser for supporting a drag line bucket from first and second cables is disclosed. The load equalizer has a main body having a central portion and side portions providing respectively first and second clamps for clamping end portions of the first and second suspension cables. A rotatable mounting is provided in the suspension central portion of the main body. A link body is suspended below the main body and connected thereto through the rotatable mounting whereby freedom of relative rotational motion is provided at least about an axis substantially at right angles to the direction between the clamps. The rotatable mounting is in a zone extending substantially between the clamps.

12 Claims, 19 Drawing Sheets

PRIOR ART

PRIOR ART

PRIOR ART

PRIOR ART

PRIOR ART

SECTION A-A

SECTION A-A

SECTION A-A

SECTION A–A

SECTION B-B

HOIST ROPE EQUALISER

BACKGROUND OF THE INVENTION

The present invention relates to a hoist rope equaliser and is more particularly directed to a system in which an object is to be suspended and moved in a system having a plurality of hoist ropes which connect to the equaliser and the equaliser has a plurality of flexible connection elements such as chains on which the object is mounted. The equaliser has a structure such that load on the respective flexible elements is equalised and the line of action preserved along the direction of elongation of each of the support cables. A particular application of the invention but not necessarily its only application is to a system for use with a dragline having a rigging system which supports and operates a dragline bucket.

Dragline excavators are frequently used to remove overburden to prepare an open-cut coalmining operation. A bucket is provided and capable of scooping a large volume of soil. The bucket is suspended off a long boom with support cables for causing the bucket to be dragged through the overburden, to be filled and then lifted and moved to dump the overburden at a nearby dumping location. Conventionally, the system is as schematically shown in FIGS. 1 and 2 as more particularly described hereinafter and an equaliser is used to equalise the load through left and right support cables.

The capital investment in a dragline is very high and economics dictate that components which are prone to wear can be not only inspected but also be subject of the substitution of replacement parts relatively easily and more important most speedily and safely but in a mining location using relatively simple equipment. However, long working life particularly and readily replaceable components are important. The economic effect of downtime is very significant and needs to be minimised. Accordingly, component design and longevity coupled with superior performance characteristics are desirable. It is paramount that breakdowns and non-scheduled maintenance requirements are eliminated by effective design and good performance parameters.

SUMMARY OF THE INVENTION

Broadly the present invention provides a load equaliser for supporting a dragline bucket from first and second cables;

the load equaliser having:

a) a main body having a central portion and side portions providing respectively first and second clamps for clamping end portions of the first and second suspension cables;

b) a rotatable mounting in the suspension central portion of the main body;

c) a link body suspended below the main body and connected thereto through the rotatable mounting whereby freedom of relative rotational motion is provided at least about an axis substantially at right angles to the direction between the clamps, and;

d) the rotatable mounting being in a zone extending substantially between the clamps.

Embodiments of the invention can have a very limited vertical dimension. The advantage of the overall height of the load equaliser being small permits the lifting of the bucket higher than otherwise, thereby giving the distinct economic advantage of a higher discharge position. It has been found that an embodiment can offer a higher dumping level for a typical dragline of 1 meter and furthermore the load equaliser can have a dramatic reduction in mass compared with prior art proposals typically of the order of 1 tonne, thereby permitting a greater mass of overburden to be carried in the bucket for a particular rated dragline structure.

Embodiments lend themselves to providing a lubricated rotatable mounting thereby permitting a relatively long-life and reduction in downtime for inspection, servicing and replacement. The reduction in size of the product also facilitates not only reduced weight by also reduced cost for the components required. The components, for example, may be steel or any other suitable material.

The invention lends itself to having one, two or even three degrees of freedom for rotation. A simple embodiment is one having a single degree of rotation achievable by a pivot pin forming the rotatable mounting. Rotation about the axis of the pin is provided for load equalization, the axis being at right angles to the suspension cables.

Embodiments can offer the advantage of two degrees of freedom by the equaliser body having an upper component adapted to be engaged in the rotatable mounting and having a lower portion for a second rotatable mounting, about an axis at right angles to the first rotatable mounting of the equaliser system, and thus providing a further degree of freedom for rotation of a component to be engaged with flexible coupling elements (such as chains) to the bucket structure.

Further embodiments of the invention provide for three degrees of freedom within a limited range by having a smoothly curved bearing element such as a spherical bearing in a complimentary profiled aperture in the central portion of the main body so that the applied loads through the bucket are distributed and equalised in a three dimensional sense.

BRIEF DESCRIPTION OF THE DRAWINGS

The prior art and embodiments of the invention will now be further described with reference to the accompanying drawings of which.

DESCRIPTION OF EMBODIMENTS OF THE INVENTION

Figure 1:
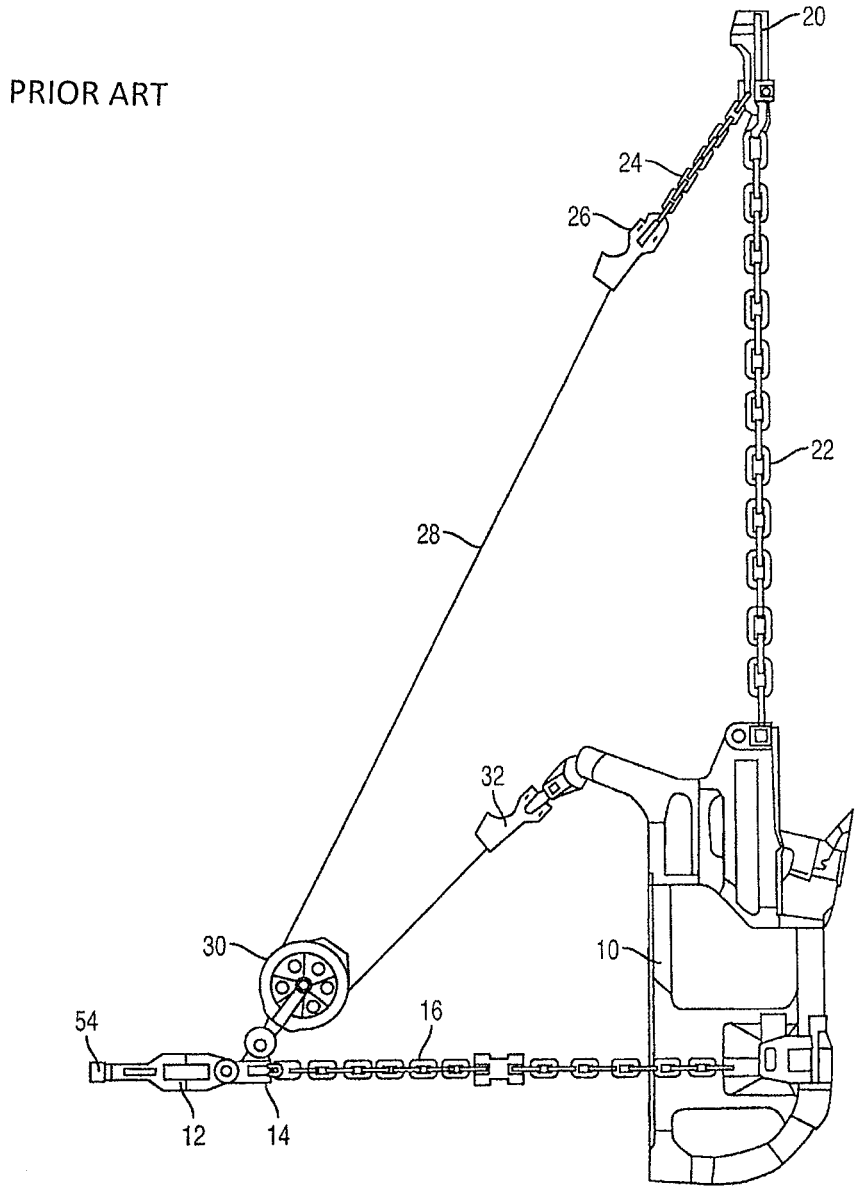
FIG. 1 is a schematic side elevation of a conventional dragline bucket and its supporting rigging.
Figure 2:
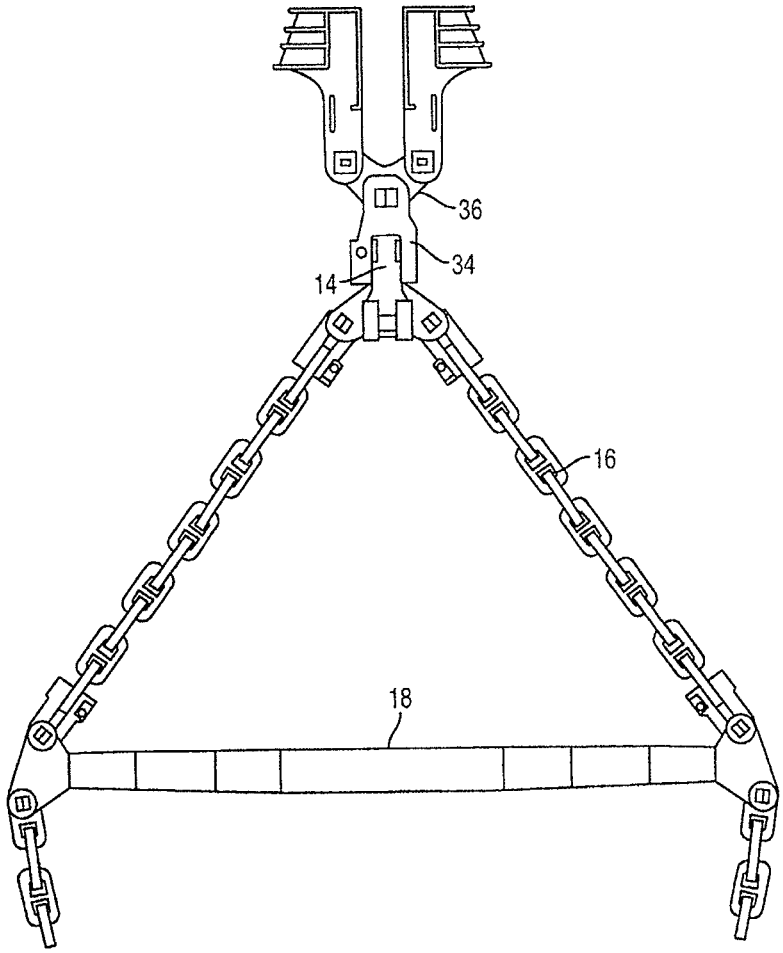
FIG. 2 is a front elevation of just the rigging used for the bucket of FIG. 1 in accordance with conventional arrangements.

Firstly reference should be made to FIGS. 1-7 which illustrates a prior art dragline system having an equalizer for a plurality of hoist ropes. FIGS. 1 and 2 show in overall form a general arrangement wherein an excavation bucket 10 is adapted to be suspended on suspension ropes connected through an adapter 12 which at its lower end has a tri-link connector 14 from which a pair of hoist chains 16 depend for mounting the excavation bucket. FIG. 2 shows the chains spaced apart at an intermediate position by a spreader bar 18. The bucket is adapted to be dragged through over burdened to be loaded by traction applied through a connector 20 which is connected by a drag chain 22 to the front of the bucket. The connector 20 is also connected to a suspension chain 24 which itself is connected through a dump socket 26 and a dump rope 28. The dump rope extends around a dump block 30 to a terminal dump socket 32 which connects through to the upper leading portion of the bucket. The dump block 30 is connected through a pinned joint arrangement to a forward link of the tri-link 14 about a transverse axis.

Figure 4:
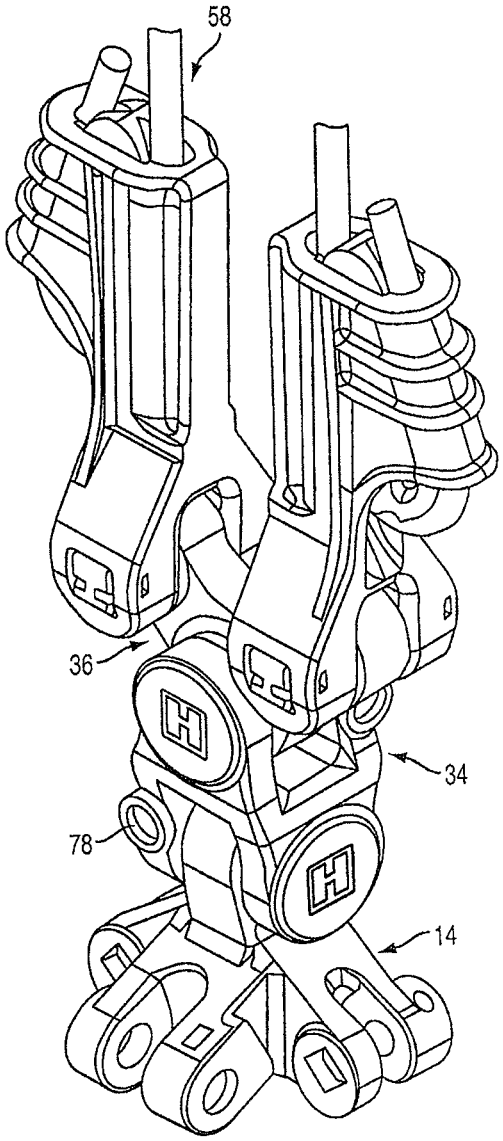
FIG. 4 is an assembled view of the equaliser of FIG. 3.

FIG. 4 shows in perspective the adapter 12 assembly of the tri-link connector 14 to a hoist link 34 which in turn connects to the body of equalizer 36. The equalizer is connected through respective pins to first and second hoist rope clamps described in detail later.

Figure 7:
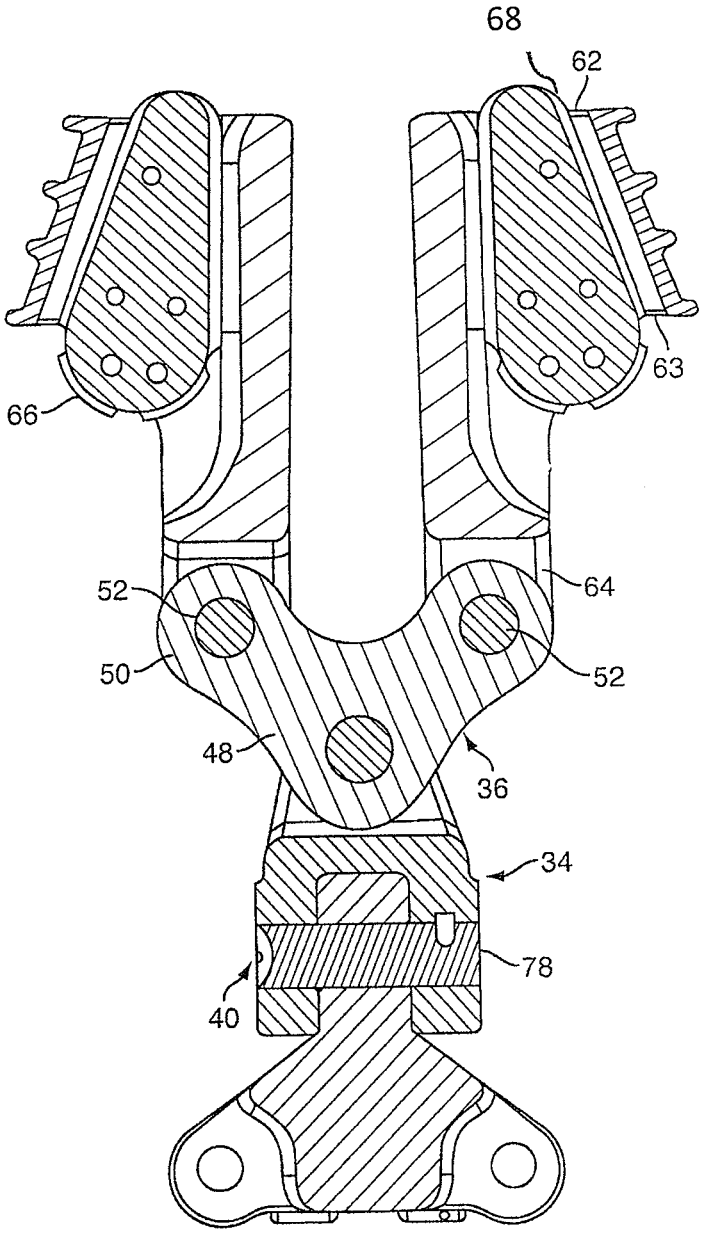
FIG. 7 is a sectional elevational taken along the line A-A of FIG. 6.

FIG. 7 shows the respective pivot pins from which is will be apparent that 2 degrees of freedom of motion the equalizer 36 and the hoist link 34 with repetition about a first connector pin which extends transversely and a second connector pin which also extends horizontally but has its axis extending longitudinally of the whole apparatus.

More detailed description of the separate sub-components will now be given.

Figure 3:
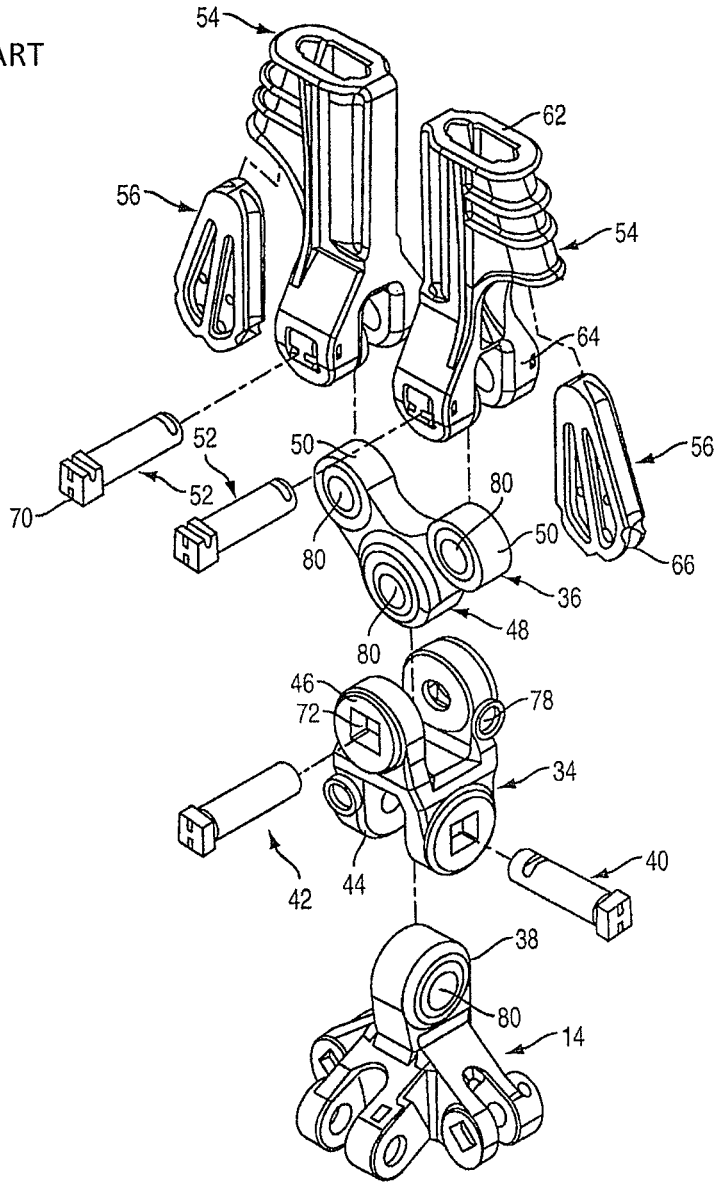
FIG. 3 is an exploded view of a prior art embodiment such as is used in the arrangement of FIGS. 1 and 2 for load equalising a dragline bucket.

As shown in FIG. 3, the tri-link 14 has an upper connector 38 which is pinned by pin 40 (extending traversely) to hoist link 34 to provide an additional degree of rotation. The hoist link 34 in turn is pinned to the equaliser 36 by pin 42 extending horizontally and by the longitudinal direction of the excavator. This is achieved by having the lower link arms 44 orientated traverse to the upper link arms 46. This two degree of freedom relationship is best illustrated in FIG. 4 showing the assembly.

FIG. 7 conveniently shows the respective pins providing two degrees of freedom rotation. The equaliser 36 body has a connector 48 located at the lower centre, and a pair of connectors 50 extending laterally from the upper body. The lower connector 48 is pinned to hoist link 34 as described above. Each of the connectors 50 is connected to a hoist rope clamp by respective pins 52.

In this arrangement, the equaliser 36 equalises the hoist rope 58 loads.

Conveniently shown in FIG. 3 the hoist rope clamp comprise of a hoist socket 54, and a locking wedge 56 around which a rope extends in the use to be clamped between the periphery of the wedge and the complementary interior surfaces of a cavity 63 of the hoist socket 54. The hoist socket 54 has a pair of legs 64 pivotally connected through pin 52 to the equaliser 36.

The locking wedge 56 is pear shaped with two elongate wedge surfaces 68, connected by curved end 66.

The hoist rope 58 is suspended vertically down from the top of a boom (not shown), and enters an aperture 62 at the top of the cavity 63 and extends around the curved end 66 of the locking wedge 56 and re-enters the cavity 63. The free end of the hoist rope 58 exits from aperture 62. When hoist rope 58 is tensioned, the locking wedge 56 is forced towards the aperture 62.The wedge surfaces 68 and the corresponding surface of the cavity 63 applies pressure to the hoist rope 58. This causes friction to secure the hoist rope 58 to the hoist socket 54. FIG. 7 illustrates the locking wedge 56 mated with the hoist socket 54.

The pins 40, 42, 52 have circular shaft and a square pin head 70, which engages with a corresponding square pin aperture 72. Perpendicular to the axis of the shaft of the pin is a pin retention groove 74. When the pins are inserted into the desired position, a retention pin 76 is inserted through a retention pin aperture 78 to secure the pins 40, 42, 52, as shown in FIG. 7. The pin retention groove 74 is not limited to be positioned on the shaft, and pin 70 has a further pin retention groove 74 on the square pin head 70.

Within the connector 38 48 50, there is a bearing 80 that interfaces between the shaft of the pin 40 42 52 and the inner surface of the connector to reduce friction wear and friction.

Figure 5:
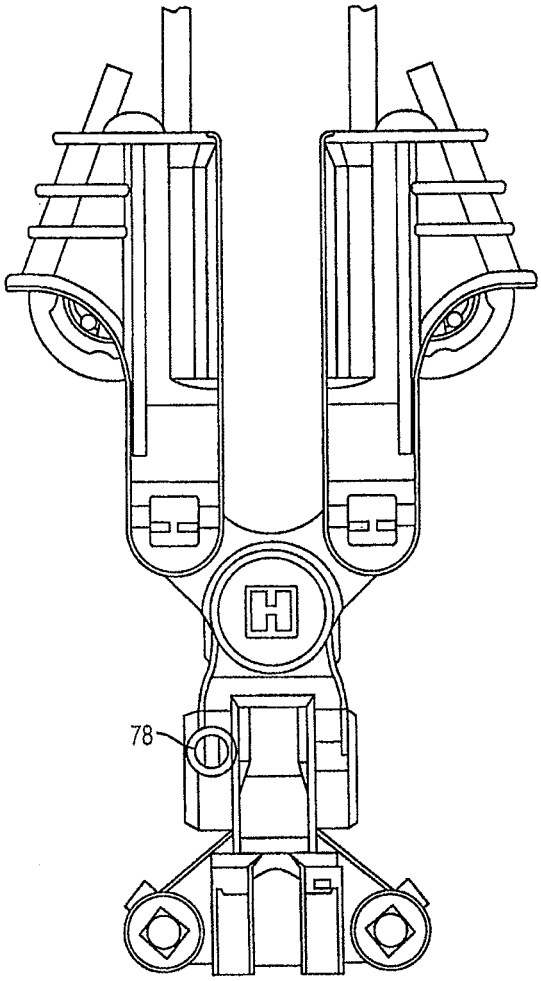
FIG. 5 is a front elevation of the equaliser of FIG. 3.
Figure 6:
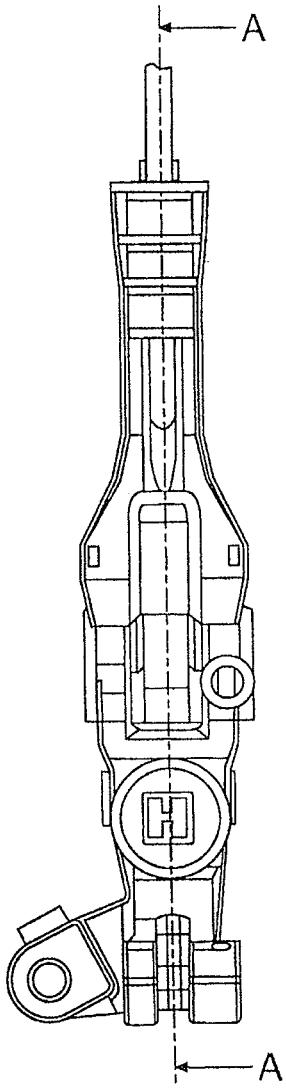
FIG. 6 is a side elevation of the equaliser of FIG. 3.

FIGS. 5 and 6 shows the prior art adapter 12 assembly comprising of hoist socket, equaliser 36, hoist link 34 and tri-link 14. The drawback of this prior art is the multiple components in vertical arrangement, which decreases how high the bucket and rigging can be lifted. In addition, multiple components increases weight of the rigging and increase the maintenance burden.

In the embodiments, the same reference numbers have been used for like parts and only the differences will be fully described.

FIG. 8-12 illustrates a first embodiment of the present invention, comprising of a tri-link 84 connected to an integrated socket equaliser 82 by a connector pin 86, and a pair of locking wedges 56. The locking wedges 56 operate in the same manner to the prior art to secure the hoist ropes 58.

Figure 9:
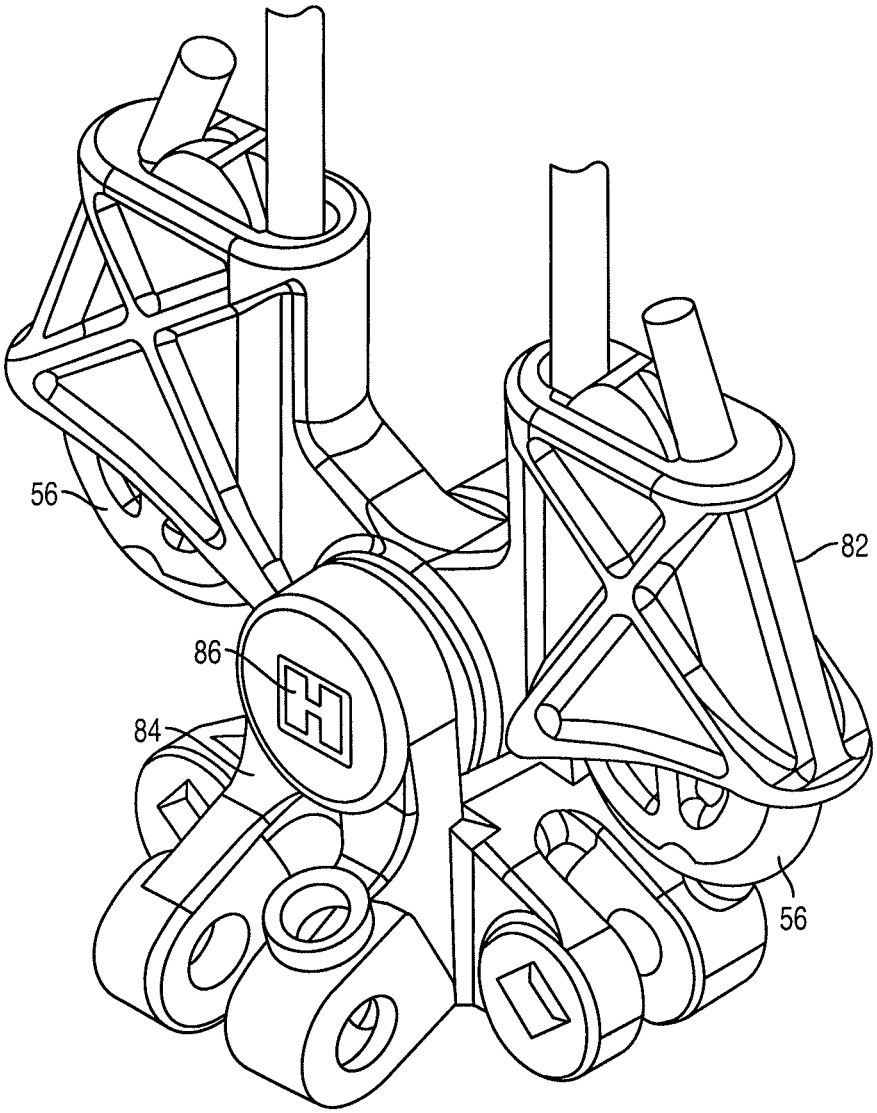
FIG. 9 is a view of the equaliser of FIG. 8 when assembled.

FIG. 9 shows in perspective the first embodiment where it is apparent the tri-link 84 has one degree of freedom of motion relative to the integrated socket equaliser body 82. This arrangement allows the tri-link 84 to have limited rotation from central alignment, while equalising the load on the hoist chains 16.

Figure 12:
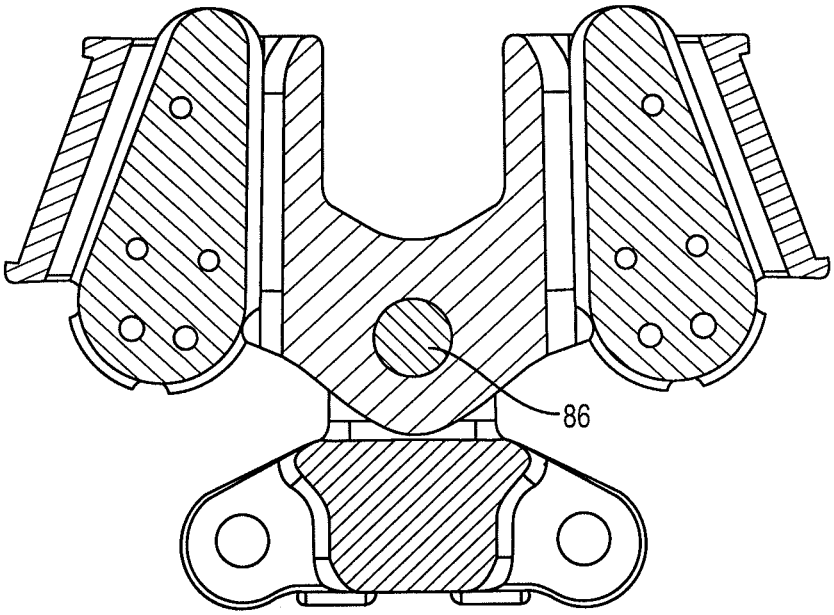
FIG. 12 is a sectional elevation along the line A-A of FIG. 11.
Figure 13:
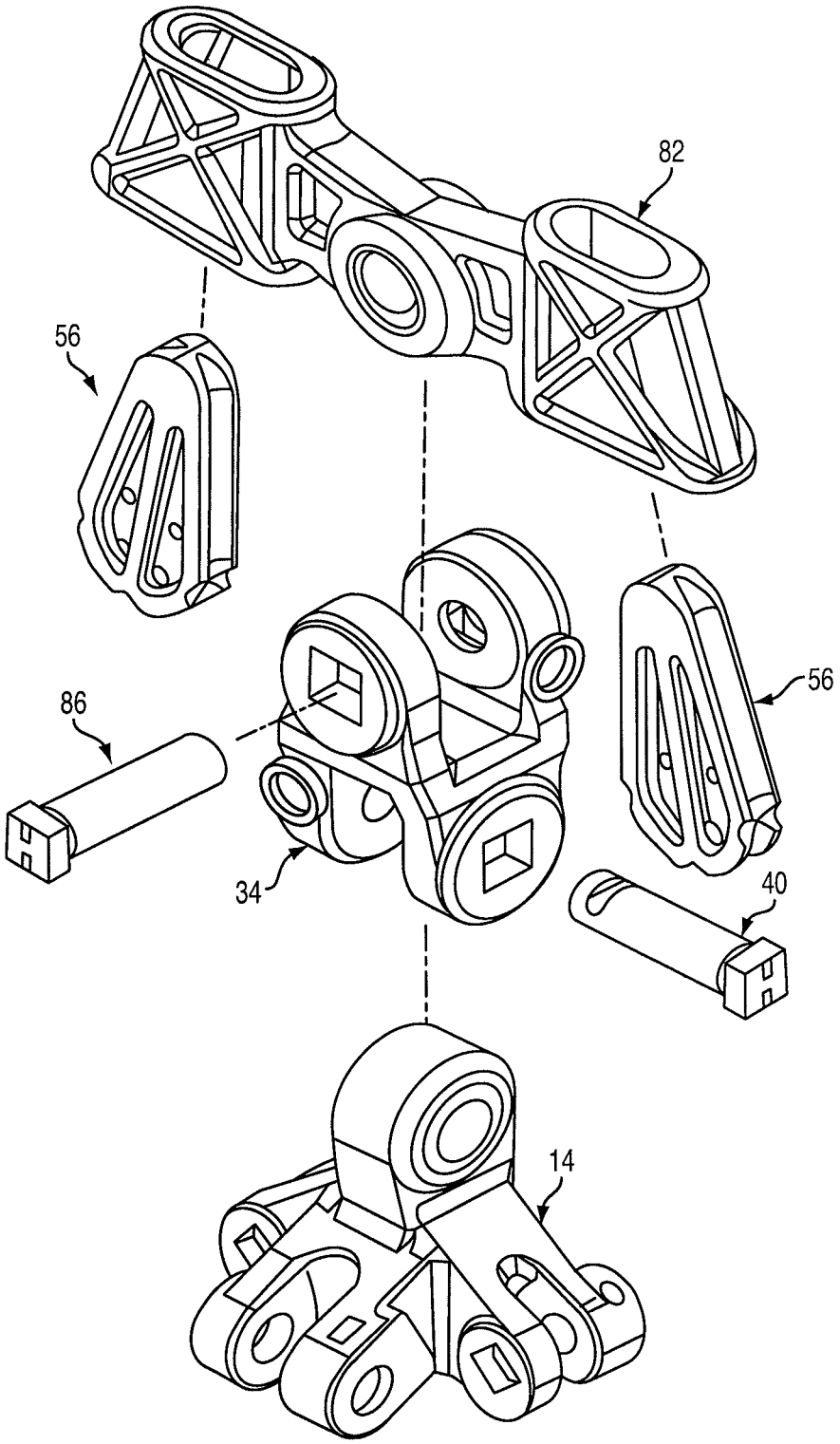
FIG. 13 is an exploded perspective view of a second embodiment of the invention.
Figure 14:
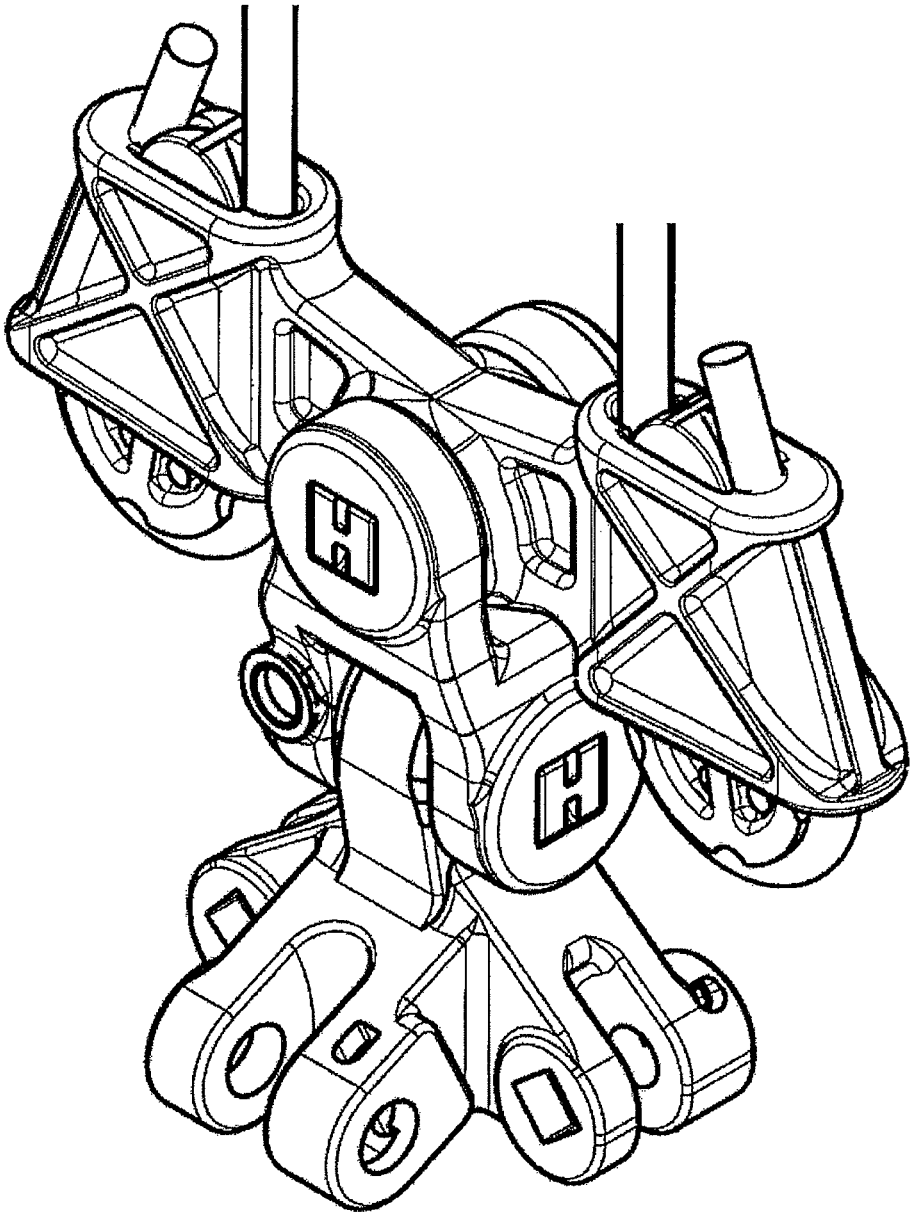
FIG. 14 is a view of the equaliser of FIG. 13 when assembled.
Figure 15:
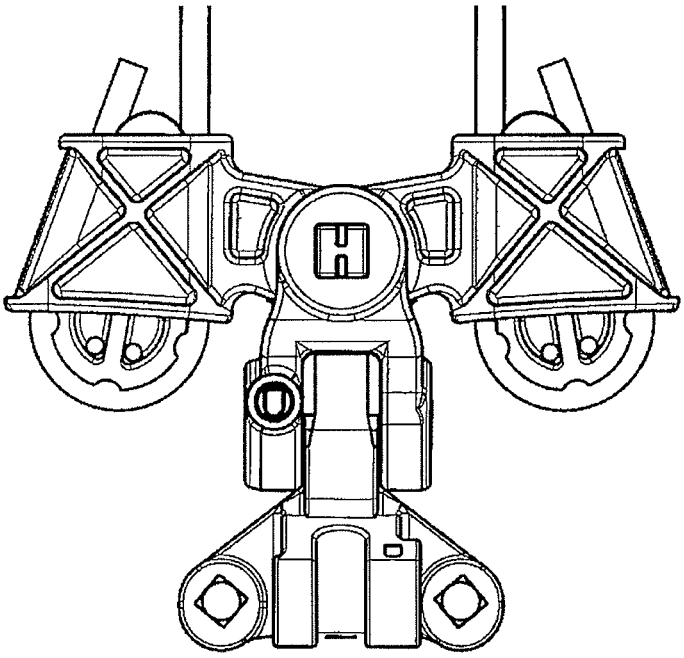
FIG. 15 is a front elevation equaliser of FIG. 13.
Figure 16:
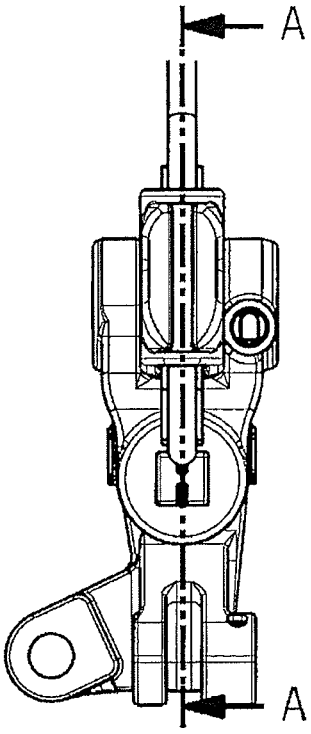
FIG. 16 is a side elevation equaliser of FIG. 13.

FIG. 12 shows the connector pin 86 extending longitudinally of the apparatus to allow load equalisation and rotation around the longitudinal axis.

A more detailed description of the separate sub-components of the first embodiment will now be given.

Figure 8:
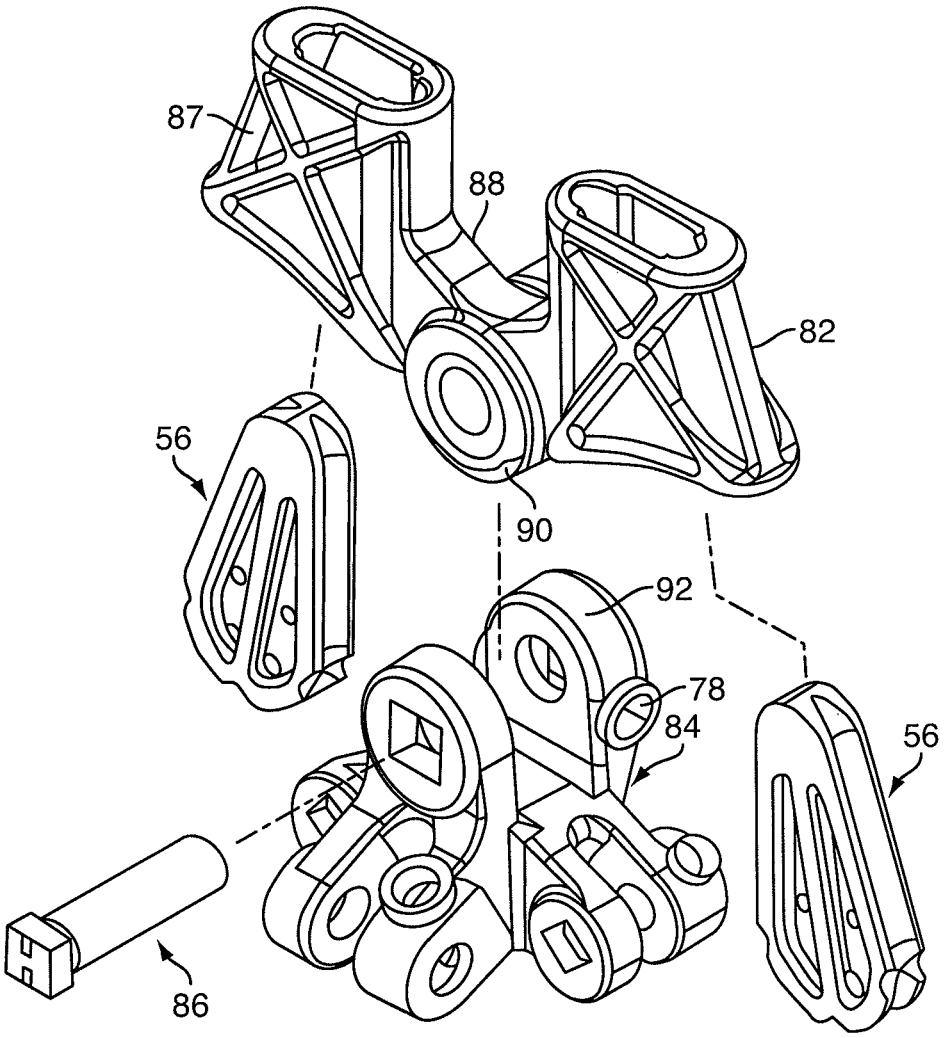
FIG. 8 is an exploded perspective view of a first embodiment of the invention.

FIG. 8 is an exploded drawing of the first embodiment of the present invention, showing an integrated socket equaliser 82 comprising two integrated hoist rope clamps 87 extending laterally from the body, joined by a central web 88, and a central connector 90 located on the central web. The hoist rope clamps 87 are the same as the hoist socket 54 and locking wedges 56 described above, except for absence of legs 64. Instead of legs 64, there is a central connector 90.

The tri-link 84, is substantially similar to tri-link 14 except the connector 38 has been replaced with link 92.

Figure 10:
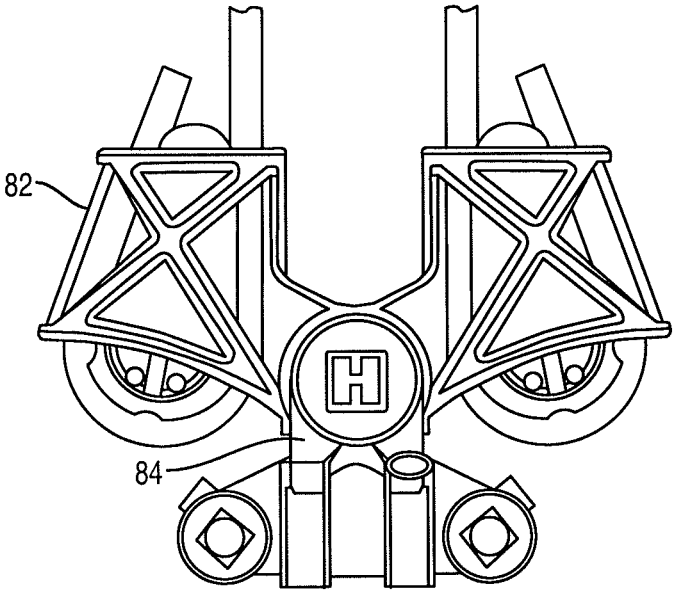
FIG. 10 is a front elevation equaliser of FIG. 8.
Figure 11:
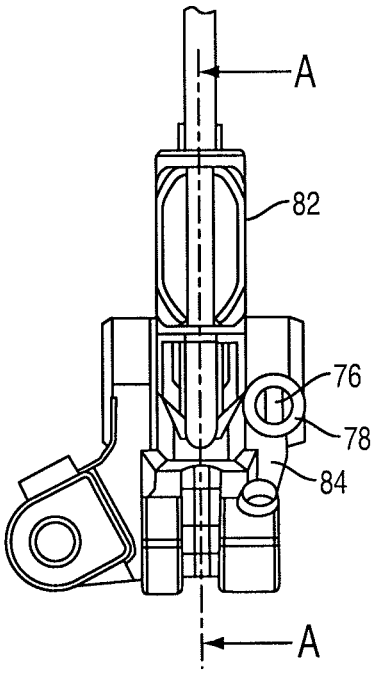
FIG. 11 is a side elevation equaliser of FIG. 8.

FIGS. 10 and 11 show the advantage of the first embodiment, compared to prior art in FIGS. 5 and 6. The reduced size and mass of the adapter 12 of this embodiment using an integrated socket equaliser 82 and tri-link, will allow for higher height of lift and dumping. In addition, it will reduce the material mass required in manufacture. In the case of steel, for example, this will reduce costs and weight.

FIG. 12 is a cross section of the first embodiment, and illustrates the reduced components of the adapter 12. In this embodiment, the function of the equaliser only requires a single equalising pin 86, compared to the three pins of the prior art. The pin 86 is secured using a fastener such as a retention pin 76 inserted into the retention pin aperture 78 as described above. It is desirable that pins in the various embodiments of this invention are secured in this manner.

FIG. 13-17 illustrates a second embodiment of the present invention, comprising of a tri-link 14 connected to a hoist link 34 which in turn connects to the body of the integrated socket equaliser 82, connector pins 40, 86, and a pair of locking wedges 56. The second embodiment is a further development of the first embodiment, by the addition of a hoist link 34 described above to provide an additional degree of freedom.

Figure 17:
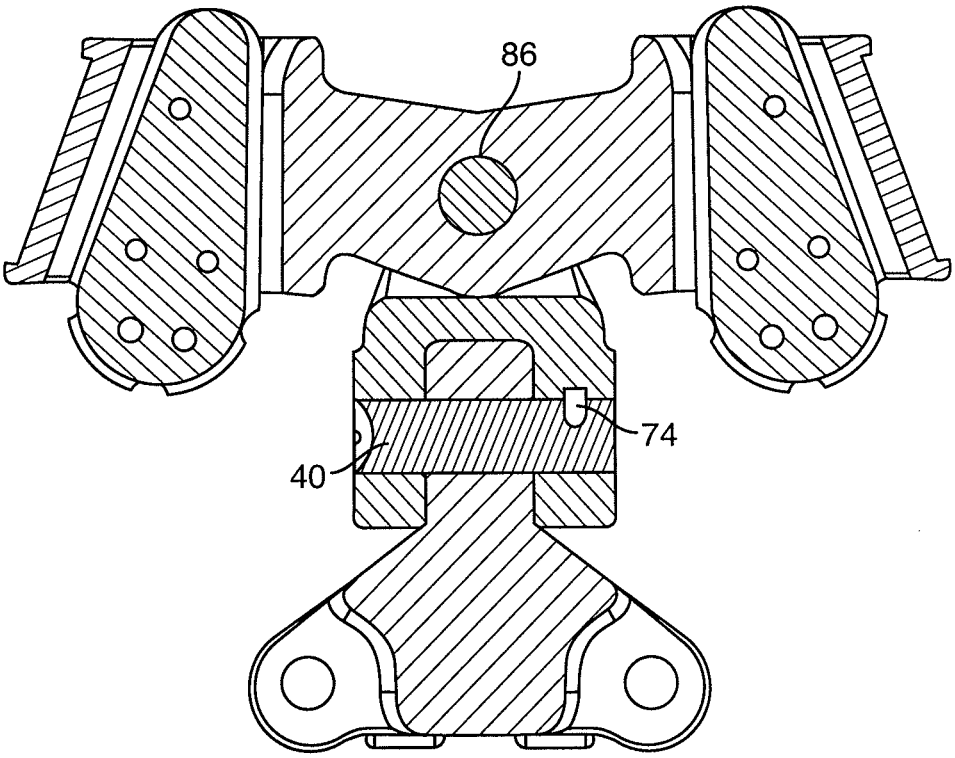
FIG. 17 is a sectional elevation along the line A-A of FIG. 16.

FIG. 17 shows the respective pins from which it is apparent that two degrees of freedom of motion is offered, where the connector pin 40 allows rotation of the tri-link 14 in the traverse axis, and connector pin 86 allows rotation in the longitudinal axis.

FIG. 18-23 illustrates a third embodiment of the present invention which allows for three degrees of freedom for rotation. The third embodiment comprises an integrated socket equaliser 94 connected to a tri-link by a spherical bearing 98, a bearing race 100, and a pair of locking wedges 56.

Figure 23:
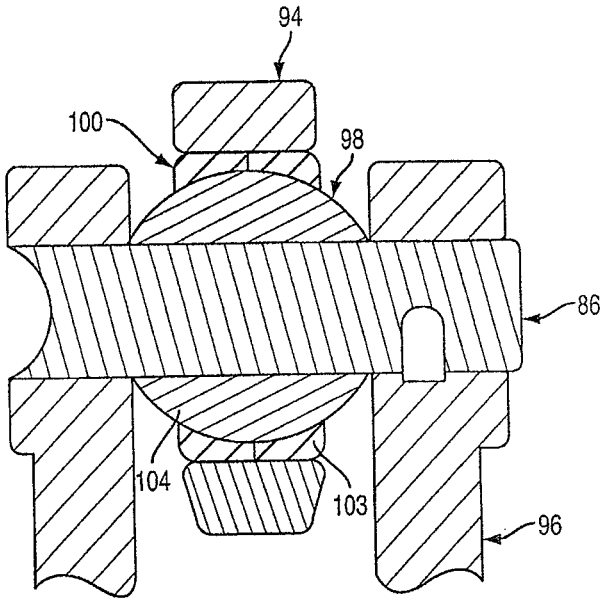
FIG. 23 is a partial view in cross-section along the line B-B in FIG. 20.

FIG. 23 is a cross section showing the assembly of the tri-link 96 connected to the integrated socket equaliser by a spherical bearing, thereby allowing limited three degree of freedom rotation.

A more detailed description of the separate sub-components of the third embodiment will now be given.

Figure 18:
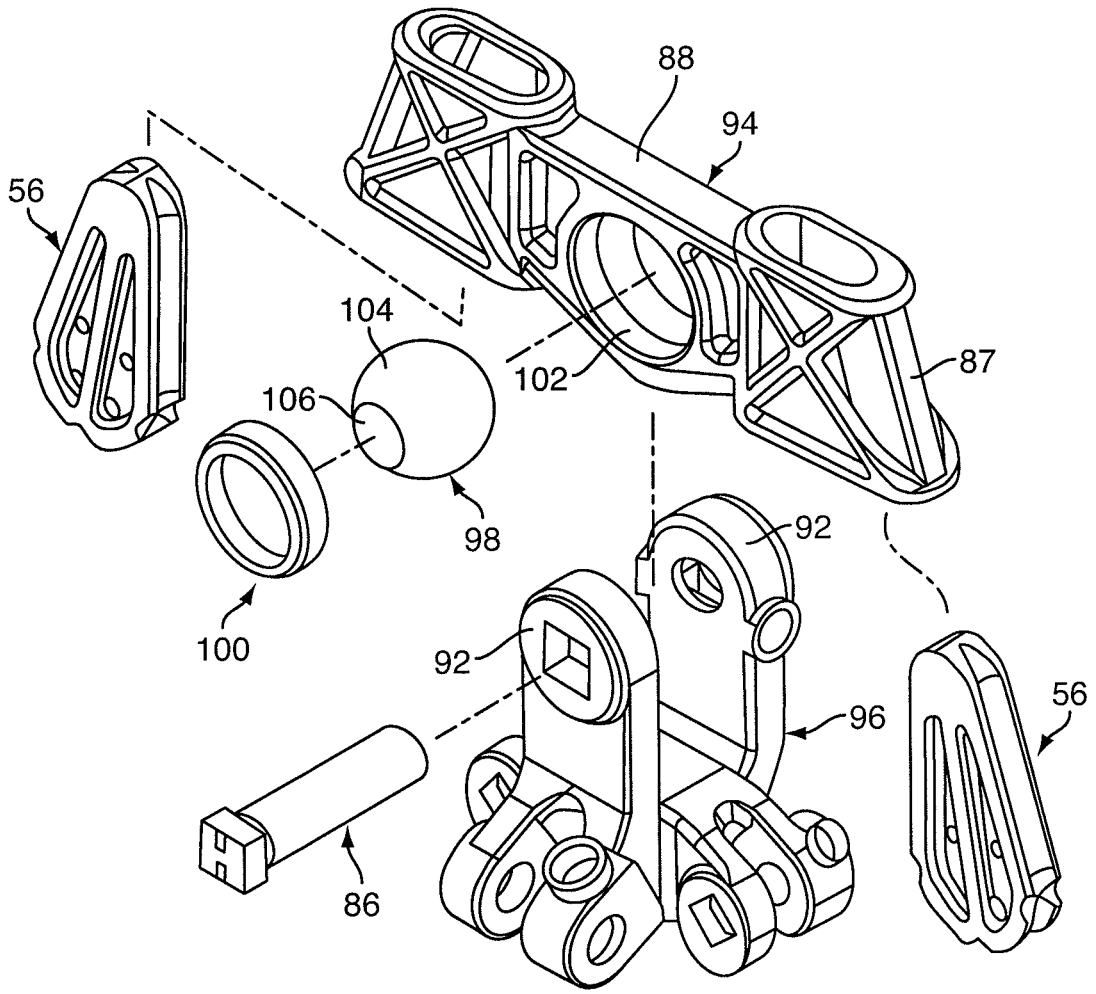
FIG. 18 is an exploded perspective view of a third embodiment of the invention.
Figure 19:
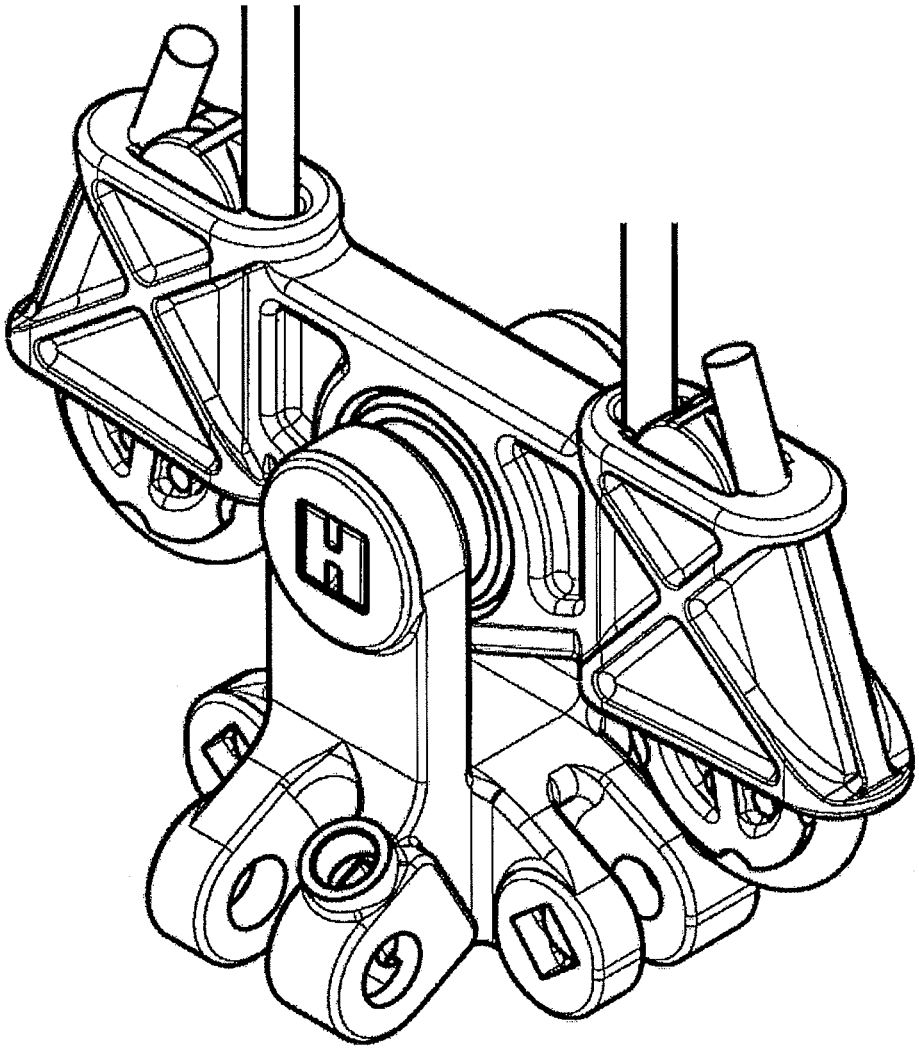
FIG. 19 is a view of the equaliser of FIG. 18 when assembled.

FIG. 18 is an exploded drawing of the third embodiment of the present invention. The integrated socket equaliser 94 comprises two integrated hoist rope clamps 87 extending laterally from the body, joined by a central web 88, and a central ball socket 102 located on the central web 88. The hoist rope clamps 87 are similar to those described in the first embodiment. The tri-link 96 is substantially similar to the tri-link 84 in the first embodiment, except for the elongated pair of links 92.

As illustrated in FIG. 23, the spherical bearing 98 is mounted centrally in the ball socket 102, and retained a bearing race 100 also mounted in the ball socket 102. The bearing race 100 is in the form of a ring, where the interior surface 103 is profiled to match the spherical surface 104 of the spherical bearing 98. This relationship enables the spherical bearing 98 to have limited three degrees of freedom rotation.

FIG. 23 conveniently shows the spherical bearing 98 pinned by pin 86 to tri-link 96. Since the spherical bearing 98 has three degrees of rotation, the degree of freedom enabled by pinning the tri-link 96 to the spherical bearing 98 is redundant. Therefore it is unnecessary to include a bearing between the shaft of the pin 86 and the interior of the aperture 106 of the spherical bearing 98. This reduces the number of parts and reduces maintenance required.

Figure 20:
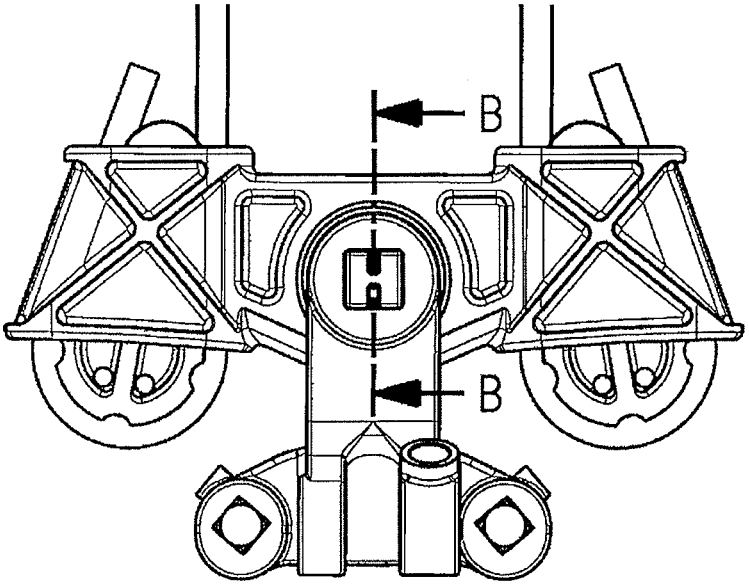
FIG. 20 is a front elevation equaliser of FIG. 18.
Figure 21:
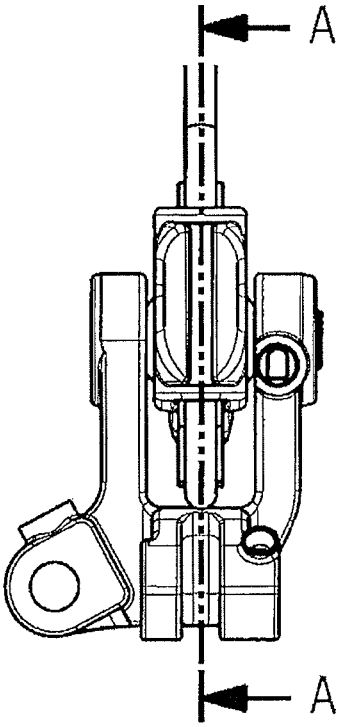
FIG. 21 is a side elevation equaliser of FIG. 18.
Figure 22:
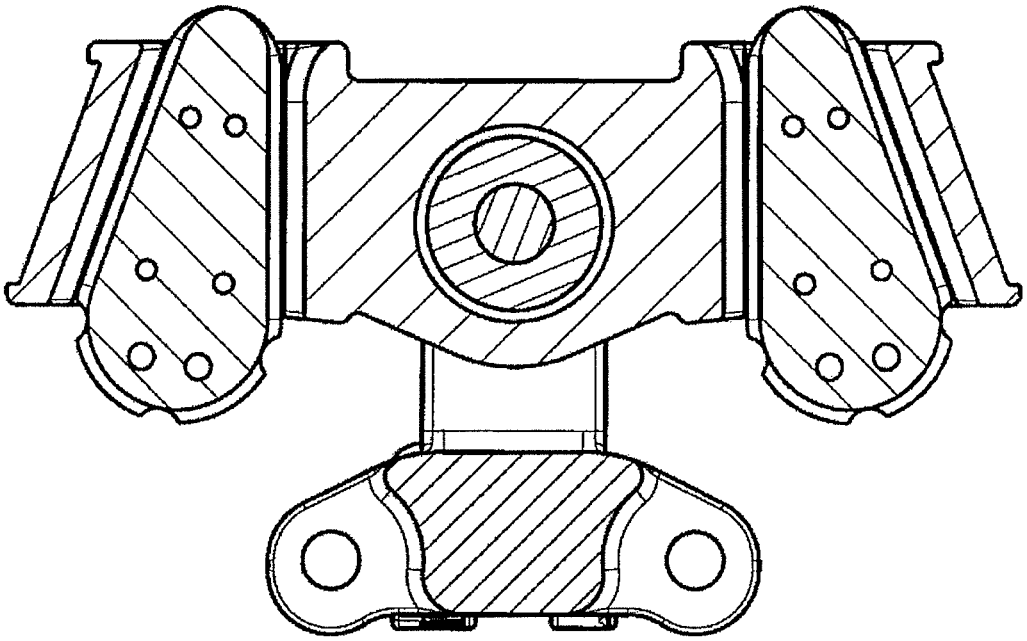
FIG. 22 is a sectional elevation along the line A-A of FIG. 21.

FIGS. 20 and 21 illustrates the third embodiment, and when compared to prior art in FIGS. 5 and 6, shows the advantages of reduced size and mass of this embodiment.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

It is to be understood that, if any prior art publication is referred to herein, such reference does not constitute an admission that the publication forms a part of the common general knowledge in the art, in Australia or any other country.

The invention claimed is:

1. A load equalizer assembly for supporting a dragline bucket from first and second suspension cables;

the load equalizer assembly having:

a) a main body having a central portion and integrated first and second clamps for clamping end portions of the first and second suspension cables, the first and second clamps each including a respective socket arranged separately from each other;

b) a rotatable mounting in the central portion of the main body; and c) a link body suspended below the main body and connected thereto through the rotatable mounting whereby freedom of relative rotational motion is provided at least about an axis substantially at right angles to the direction between the clamps;

wherein, in use, the rotatable mounting is directly between the clamps such that the axis of the rotatable mounting is disposed at or above a lowermost portion of the first and second clamps.

2. The load equalizer assembly of claim 1 wherein the link body comprises a tri-link.

3. The load equalizer assembly of claim 2 wherein the main body comprises a socket equalizer, and the tri-link is connected to the socket equalizer.

4. The load equalizer assembly of claim 3 wherein the socket equalizer is an integrated socket equalizer.

5. The load equalizer assembly of claim 1, wherein a single degree of rotation is provided through a pivot pin forming the rotatable mounting, rotation being about the pivot pin for load equalization.

6. The load equalizer assembly of claim 5 wherein the pivot pin is secured using a retention fastener.

7. The load equalizer assembly of claim 1, wherein there is provided two degrees of freedom by the link body having an upper component adapted to be engaged in the rotatable mounting and having a lower portion for a second rotatable mounting, about an axis at right angles to the first rotatable mounting of the equalizer system, and thus providing a further degree of freedom for rotation of a component to be engaged with flexible coupling elements to the bucket structure.

8. The load equalizer assembly of claim 1, wherein there is provided three degrees of freedom within a limited range by having a smoothly curved bearing element in a complimentary profiled aperture in the central portion of the main body so that the applied loads through the bucket are distributed and equalized in a three dimensional sense.

9. The load equalizer assembly of claim 1 wherein the clamps each comprise a locking wedge assembly.

10. The load equalizer assembly of claim 1 wherein the central portion of the main body comprises a central web joining the clamps.

11. The load equalizer assembly of claim 1 wherein the rotatable mounting is positioned intermediate the end portions of the first and second suspension cables when clamped in the first and second clamps.

12. A dragline system for supporting a dragline bucket comprising:

a load equalizer assembly having;

a) a main body having a central portion and integrated first and second clamps for clamping end portions of first and second suspension cables, the first and second clamps each including a respective socket arranged separately from each other;

b) a rotatable mounting in the central portion of the main body; and c) a link body suspended below the main body and connected thereto through the rotatable mounting whereby freedom of relative rotational motion is provided at least about an axis substantially at right angles to the direction between the clamps;

wherein, in use, the rotatable mounting is directly between the clamps such that the rotatable mounting is disposed at or above a lowermost portion of the first and second suspension cables.

* * * * *